United States Patent [19]

Masterson

[11] 4,020,856

[45] May 3, 1977

[54] FINGERNAIL AND HAND CLEANING APPLIANCE

[76] Inventor: Albert C. Masterson, 1048 Montview Road, Fort Collins, Colo. 80521

[22] Filed: June 28, 1976

[21] Appl. No.: 700,091

[52] U.S. Cl. ..... 132/74.5
[51] Int. Cl.[2] ..... A45D 29/18
[58] Field of Search ..... 132/74.5, 9; 128/65

[56] References Cited

UNITED STATES PATENTS

| | | | |
|---|---|---|---|
| 2,169,990 | 8/1939 | Preve | 132/73 |
| 2,360,457 | 10/1944 | Wells | 132/74.5 |
| 3,177,868 | 4/1965 | Wallace et al. | 128/65 |

*Primary Examiner*—G.E. McNeil
*Attorney, Agent, or Firm*—William E. Hein

[57] ABSTRACT

A fingernail and hand cleaning apparatus applies pulsating jets of liquid to the ends of the fingers of a user's hand while the hand is positioned in a grooved hand rest within the apparatus. Additional pulsating jets of liquid are applied to other areas of the user's hand to provide cleansing and massaging action.

7 Claims, 8 Drawing Figures

FINGERNAIL AND HAND CLEANING APPLIANCE

BACKGROUND AND SUMMARY OF THE INVENTION

This invention relates generally to human hygiene and more specifically to an appliance for automatically cleaning the fingernails of the human hand and for simultaneously cleaning and massaging various surfaces of the hand. The working environment of mechanics and other laborers and the playground environment of children regularly results in the deposit of grease and grime on the hands and under the fingernails. Thus, such persons are faced with the time consuming and generally somewhat ineffective task of manually cleaning their hands and fingernails, perhaps several times each day. Manicurists regularly use inefficient manual techniques for cleaning the fingernails and softening the cuticles of their client's hands in preparation for a manicure.

It has been found that a cleansing solution directed, as a pulsating liquid jet, at the end of a finger is highly effective in dislodging grease and other foreign matter from underneath the fingernail and in softening the cuticle surrounding the fingernail. Similarly, pulsating liquid jets of cleansing solution directed to other areas of the hand have been found to be very effective in cleaning those areas of the hand as well as in massaging the muscles of the hand.

Accordingly, it is the principal object of this invention to provide a fingernail and hand cleaning apparatus that applies a pulsating liquid jet to the ends of the user's fingers and to other areas of the hand for cleaning and massaging the hand.

Other and incidental objects of this invention will become apparent to those persons skilled in the art from an examination of the following detailed description and the accompanying drawings.

DESCRIPTION OF THE PREFERRED EMBODIMENT

Figure 1:
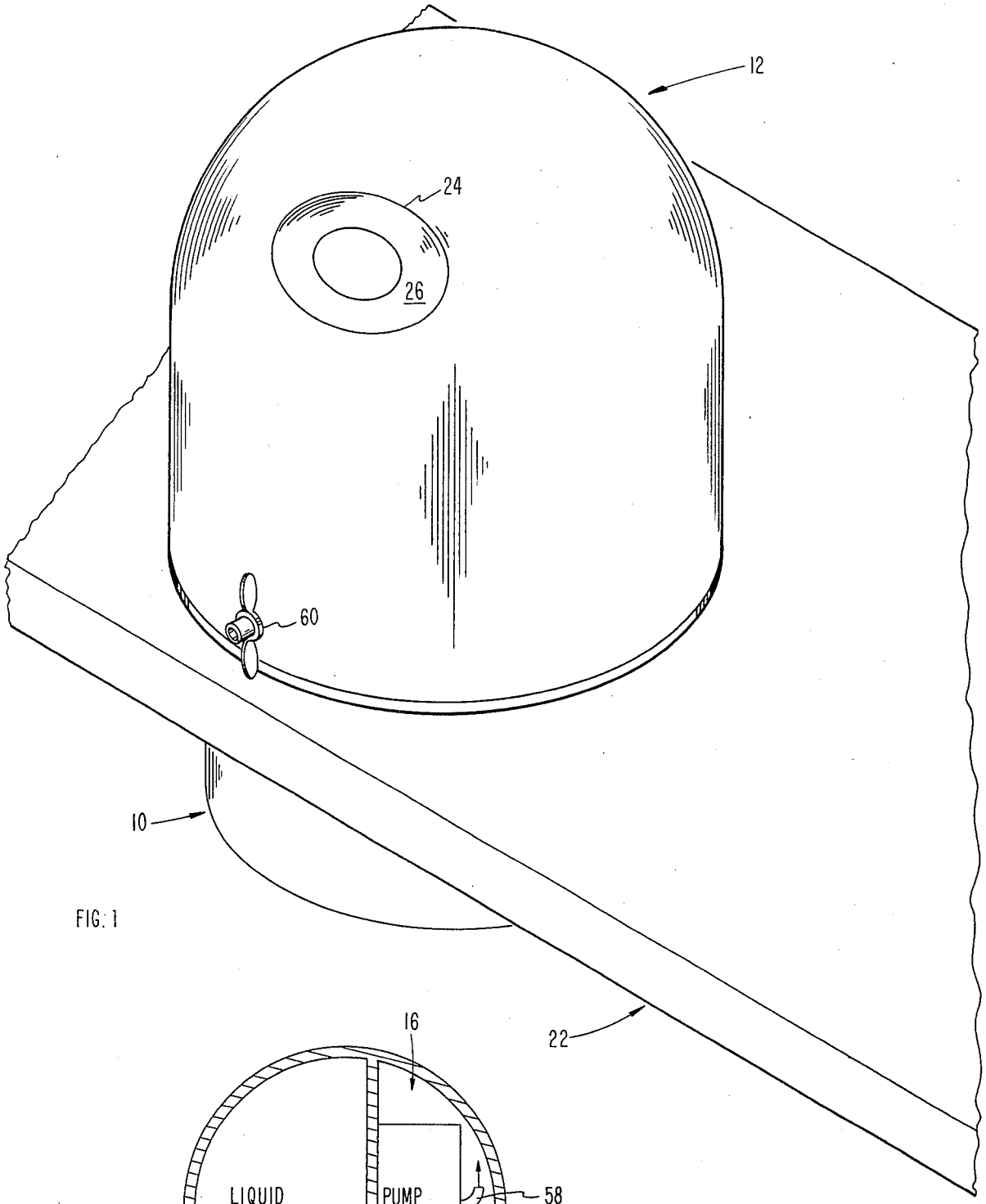
FIG. 1 is a perspective view of a fingernail and hand cleaning appliance embodying the present invention.
Figure 4:
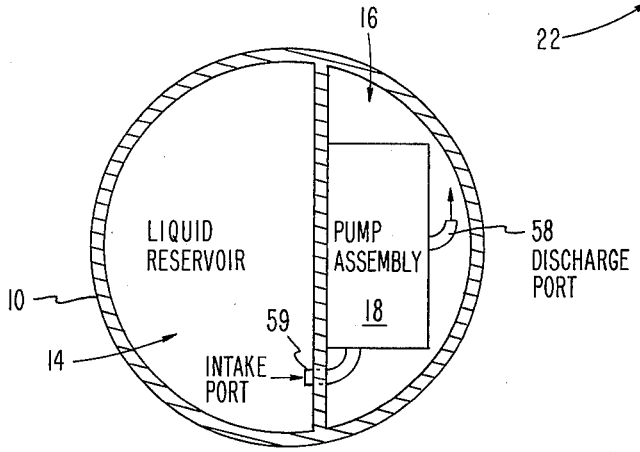
FIG. 4 is a plan view in section of the lower housing of the fingernail and hand cleaning appliance taken along the line A—A of FIG. 3.
Figure 2:
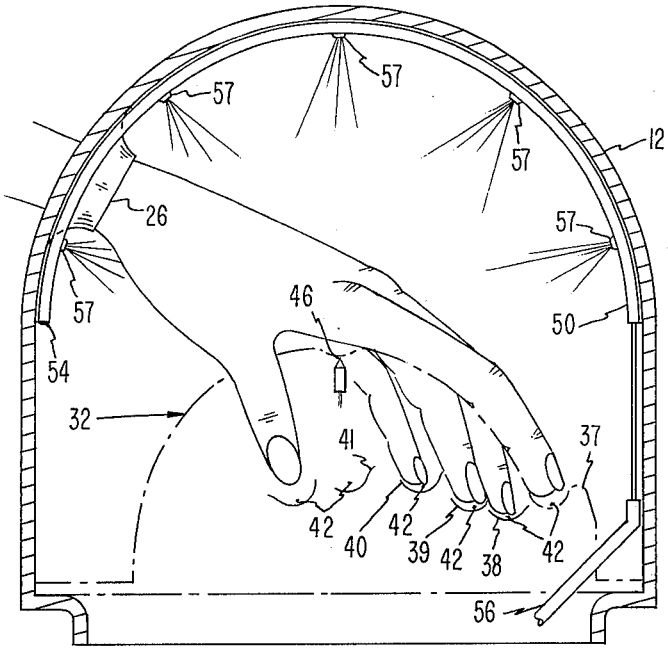
FIG. 2 is a pictorial view of the upper housing of the appliance of FIG. 1 illustrating the general position of the user's hand during operation of the appliance.
Figure 3:
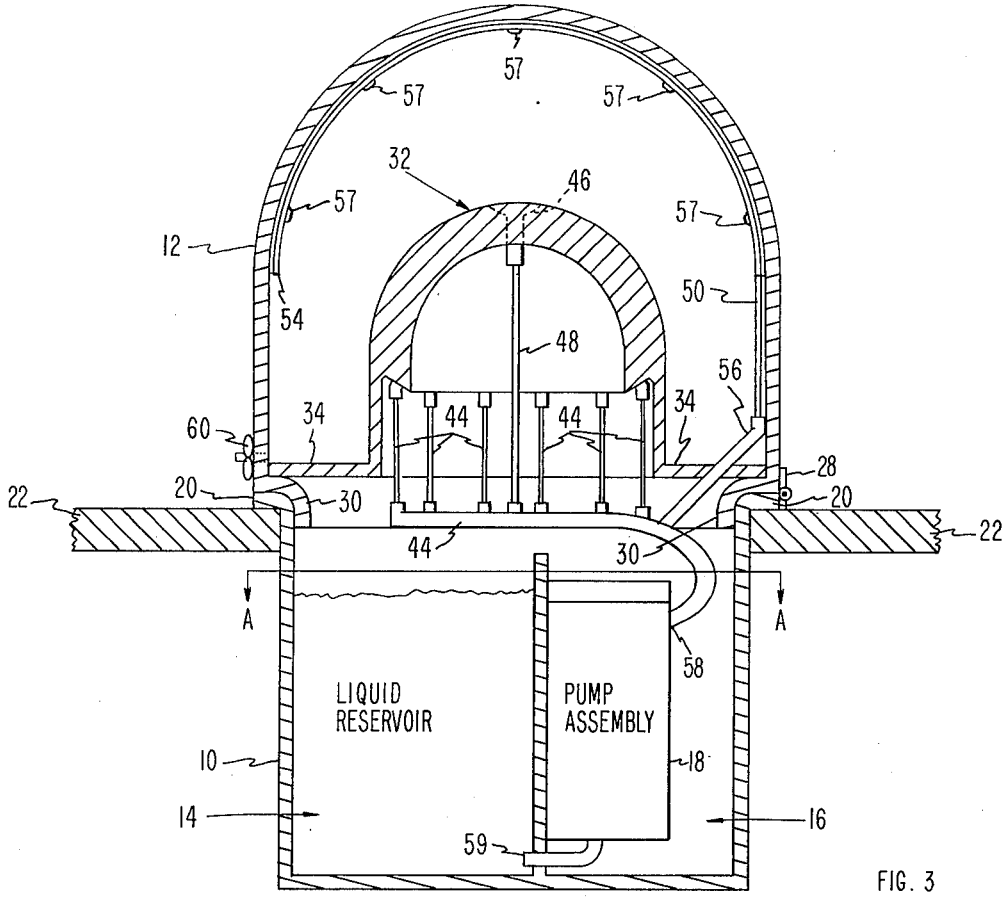
FIG. 3 is an elevation view in section of the appliances of FIGS. 1 and 2.

Referring now to FIGS. 1–3 of the drawings, the fingernail and hand cleaning appliance illustrated includes a lower housing 10 and an upper housing 12. Lower housing 10 is generally circular in cross section, having a closed bottom end and an open top end. Lower housing 10 includes a liquid reservoir 14 and a pump compartment 16 that houses a pump assembly 18. A lip 20 is formed along the periphery of the open end of lower housing 10 to support the appliance within a circular opening in a supporting base 22. Supporting base 22 may comprise, for example, a countertop that could support either one or several of the appliances. It may be desirable to arrange two or more of the appliances along a countertop to accommodate both hands of a single user simultaneously or to accommodate multiple users simultaneously. Alternatively, the appliance may be supported by merely allowing the closed end of lower housing 10 to rest upon some flat surface without providing supporting base 22.

Upper housing 12 comprises a generally hemispherical dome or bonnet that is preferably constructed of clear plastic to permit viewing the user's hand during operation of the appliance. An elliptical opening 24 in upper housing 10 accommodates the user's hand. A flexible rubber gasket 26 surrounding opening 24 prevents the escapement of liquid from within the appliance during operation. Upper housing 12 is attached to the lower housing 10 by means of a hinge 28 to permit easy access to the liquid reservoir 14. A lip 30 is formed along the periphery of upper housing 12 to mate with the lip 20 of lower housing 10 to provide mechanical rigidity as well as to prevent the escapement of liquid during operation of the appliance.

Figure 5:
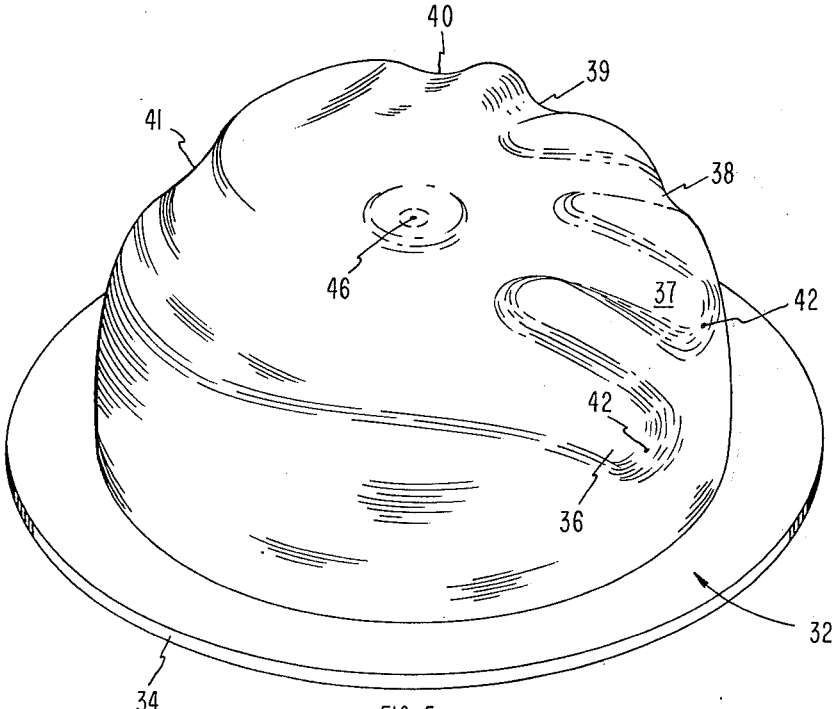
FIG. 5 is a pictorial view of the palm ball of FIGS. 2 and 3.
Figure 6:
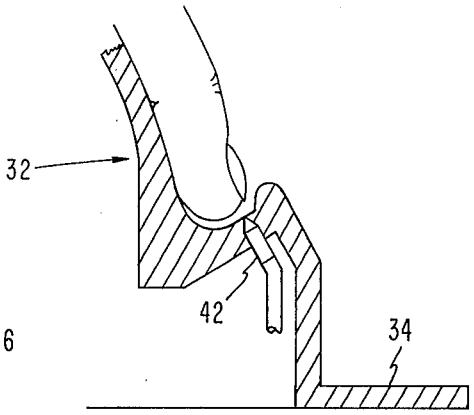
FIG. 6 is a sectional view illustrating the arrangement of a representative one of the finger receptacles of the palm ball of FIG. 5.

A palm ball 32, variously illustrated in FIGS. 2, 3, and 5, is mounted within upper housing 12 for receiving a user's hand that has been inserted into the appliance through opening 24. Palm ball 32 is generally hemispherical in shape and includes a peripheral flange portion 34 for securing the palm ball within upper housing 12. Palm ball 32 may either be constructed as a shell, or it may be generally solid. As shown in detail in FIG. 5, palm ball 32 includes six finger grooves 36–41 spaced over the exterior surface thereof to receive the fingers of the user's hand. Finger groove 41 is provided to receive the user's right thumb, and finger groove 36 is provided to receive the user's left thumb. A nozzle 42 is mounted at the end of each of the finger grooves 36–41 and is positioned to direct a pulsating jet of liquid toward the end of each finger to dislodge dirt from beneath the fingernails. FIG. 6 illustrates in detail a preferred arrangement of a typical one of the finger grooves or receptacles 36–41 and its associated nozzle 42. All six of the finger grooves 36–41 formed around the exterior surface of palm ball 32 are arranged as illustrated in FIG. 5.

Each of the six nozzles 42 associated with finger grooves 36–41 is connected by means of a suitable length of flexible tubing 44 to a discharge port 58 of pump assembly 18. A nozzle 46 is mounted in the center of palm ball 32 to direct a pulsating jet of liquid toward the palm of the user's hand. Another length of flexible tubing 48 is similarly employed to convey liquid from pump assembly 18 to nozzle 46.

Figure 7:
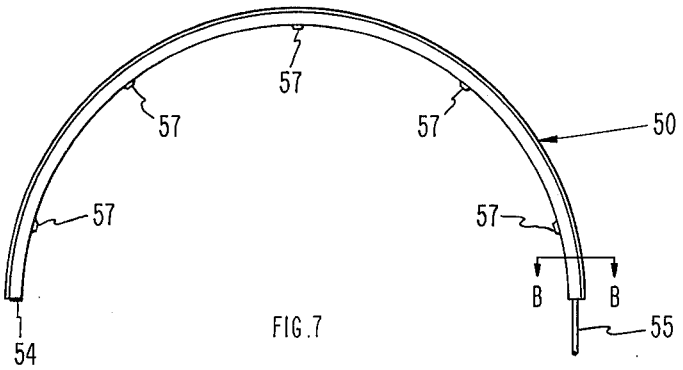
FIG. 7 is a side elevation view of the nozzle strip of FIGS. 2 and 3.
Figure 8:
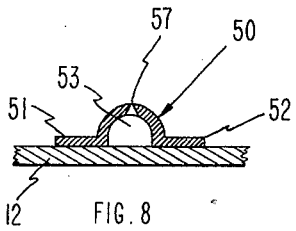
FIG. 8 is a view in section of the nozzle strip of FIG. 7 taken along the line B—B.

A generally semicircular nozzle strip 50, shown in detail in FIGS. 7 and 8, is formed so as to be substantially U-shaped in cross section with a pair of flanges 51 and 52 extending the length of the nozzle strip. Nozzle strip 50, which may be fabricated of the same plastic material as upper housing 12, is sealed by means of flanges 51 and 52 to the inner surface of upper housing 12 so as to form a cavity 53 extending the length of nozzle strip 50. Cavity 53 is plugged at one end 54 of nozzle strip 50 and is terminated at the other end of nozzle strip 50 in a tube 55 for coupling cavity 53 to a length of flexible tubing 56. Flexible tubing 56 is in turn connected to receive liquid from the discharge port 58 of pump assembly 18. A plurality of nozzles 57 are positioned as desired along nozzle strip 50 to direct pulsating liquid jets onto the top surface of the user's hand. Nozzles 57 may merely comprise pinholes appropriately positioned along nozzle strip 50.

Pump assembly 18 may comprise any of a number of commercially available pumps of the type that discharge a pulsating stream of liquid. Alternatively, pump assembly 18 may be constructed as shown and described in detail in U.S. Pat. Ser. No. 3,393,673 issued July 23, 1968 to John W. Mattingly.

In operation, pump assembly 18 withdraws liquid from reservoir 14 at intake port 59 and pulsatingly discharges that liquid at discharge port 58 into the various lengths of flexible tubing that are connected to finger groove nozzles 42, palm nozzle 46, and nozzles 57 of nozzle strip 50. The resulting pulsating jets of liquid emitted at nozzles 42 serve to dislodge foreign material from beneath the user's fingernails. The pulsating jet of liquid emitted at palm nozzle 46 serves to clean and massage the palm area of the user's hand. Similarly, the pulsating jets of liquid emitted at nozzles 57 serve to clean and massage the top surface of the user's hand. Liquid which has been discharged from nozzles 42, 46, and 57 is retained within upper housing 12 in the event it is desired that the user's hand remain in contact with the pumped liquid for a period of time following exhaustion of the liquid supply stored in reservoir 14. This may be desirable to effect further softening of the user's fingernail cuticles, for example, or to achieve some medical or therapeutic effect. The previously pumped liquid may be drained from upper housing 12 by means of a manually operative drain valve 60. The liquid contained within reservoir 14 may comprise any of a number of readily available skin cleansing solutions, or it may contain a solution that is designed specifically to soften the hands and fingernail cuticles or to achieve some desired medical result.

While the present invention has been described in connection with a preferred embodiment thereof, it will become apparent to those persons skilled in the art that various modifications and applications are possible. It is desired, therefore, that the invention not be limited to the details of construction illustrated and described hereinabove, and it is intended by the appended claims to cover all modifications which fall within the spirit and scope of the invention.

I claim:

1. A fingernail and hand hygiene appliance comprising:

a housing including a port through which the user's hand may be inserted;

a hand rest mounted within the housing, said hand rest including a plurality of finger receptacles for receiving the fingers of the user's hand;

fingernail nozzle means positioned within each one of said plurality of finger receptacles for directing a pulsating liquid jet toward each of the fingernails of the user's hand;

a reservoir for storing a supply of liquid; and pump means including an intake port coupled to said reservoir and a discharge port coupled to said fingernail nozzle means, said pump means being operative for withdrawing liquid from said reservoir and for discharing the liquid in pulsating jets for delivery to said fingernail nozzle means.

2. A fingernail and hand hygiene appliance as in claim 1 further comprising:

a palm nozzle positioned within said hand rest and coupled to the discharge ports of said pump means for directing a pulsating liquid jet toward the palm area of the user's hand; and one or more upper hand nozzles positioned within said housing and coupled to the discharge port of said pump means for directing one or more pulsating liquid jets toward the top surface of the user's hand.

3. A fingernail and hand hygiene appliance as in claim 1 wherein:

said housing comprises a generally hemispherical transparent bonnet having a gasketed port through which the user's hand may be inserted;

said hand rest is generally hemispherical in shape; and said finger receptacles comprise grooves positioned around the hemispherical surface of the hand rest for receiving each of the fingers of the user's hand.

4. A fingernail and hand hygiene appliance as in claim 2 wherein:

said housing comprises a generally hemispherical transparent bonnet having a gasketed port through which the user's hand may be inserted;

said hand rest is generally hemispherical in shape; and said finger receptacles comprise grooves positioned around the hemispherical surface of the hand rest for receiving each of the fingers of the user's hand.

5. A fingernail and hand hygiene appliance comprising:

a generally cylindrically shaped lower housing having a closed bottom end and an open top end;

a generally hemispherically shaped transparent upper housing hingedly positioned over the open end of said lower housing, said upper housing including a port through which the user's hand may be inserted;

a generally hemispherically shaped palm ball mounted within said upper housing for receiving the user's hand, said palm ball including a plurality of finger grooves positioned around the hemispherical surface thereof for receiving each of the fingers of the user's hand;

fingernail nozzle means positioned within each of said plurality of finger grooves for directing a liquid jet toward each of the fingernails of the user's hand;

a reservoir within said lower housing for storing a supply of liquid; and pump means mounted within said lower housing, said pump means including an intake port coupled to said reservoir and a discharge port coupled to said fingernail nozzle means, said pump means being operative for withdrawing liquid from said reservoir and for discharging the liquid in pulsating jets for delivery to said fingernail nozzle means.

6. A fingernail and hand hygiene appliance as in claim 5 further comprising palm nozzle means positioned within said palm ball and coupled to the discharge port of said pump means for directing a pulsating liquid jet toward the palm area of the user's hand.

7. A fingernail and hand hygiene appliance as in claim 6 further comprising a semicircular nozzle strip mounted within said upper housing, said nozzle strip including one or more nozzles coupled to the discharge port of said pump means and arranged for directing one or more pulsating liquid jets toward the top surface of the user's hand.

* * * * *